US007809290B2

(12) United States Patent
Tamagaki

(10) Patent No.: US 7,809,290 B2
(45) Date of Patent: Oct. 5, 2010

(54) IMAGE PROCESSING APPARATUS

(75) Inventor: Akira Tamagaki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 65 days.

(21) Appl. No.: 11/845,942

(22) Filed: Aug. 28, 2007

(65) Prior Publication Data

US 2008/0224387 A1 Sep. 18, 2008

(30) Foreign Application Priority Data

Sep. 1, 2006 (JP) ..... 2006-238006

(51) Int. Cl.
*G03G 15/00* (2006.01)

(52) U.S. Cl. ..... 399/21; 399/18; 399/19; 271/258.01; 271/259; 271/258.02; 271/258.04

(58) Field of Classification Search ..... 271/258.01, 271/259, 258.02, 258.04; 399/16, 18–21
See application file for complete search history.

(56) References Cited

U.S. PATENT DOCUMENTS

| | | | | |
|---|---|---|---|---|
| 4,084,900 | A * | 4/1978 | Yamaoka et al. | 399/21 |
| 4,307,957 | A * | 12/1981 | Kitagawa et al. | 399/21 |
| 5,970,274 | A * | 10/1999 | Rath | 399/21 |
| 6,720,546 | B1 * | 4/2004 | Foret et al. | 250/223 R |
| 7,085,504 | B2 * | 8/2006 | Matsuyama et al. | 399/21 |
| 7,454,145 | B2 * | 11/2008 | Weaver et al. | 399/9 |

FOREIGN PATENT DOCUMENTS

| | | |
|---|---|---|
| JP | 64-034834 | 2/1989 |
| JP | 01-275350 | 11/1989 |
| JP | 08-108968 | 4/1996 |

* cited by examiner

*Primary Examiner*—Saúl J Rodríguez
*Assistant Examiner*—Luis Gonzalez
(74) *Attorney, Agent, or Firm*—Renner, Otto, Boisselle & Sklar, LLP

(57) ABSTRACT

The present invention provides an image processing apparatus which can promptly detect whether or not a jam has been removed in the case of occurrence of the jam such as a paper jam. A paper feeding apparatus 1*b* includes a paper feed tray 11, a pickup roller 61, a paper roller 63, a sorting roller 64, feeding rollers 66*a*, resist rollers 67, a paper ejection roller 73, a passage detection sensor 69, an overlapped feeding detection sensor 68 and a second detection apparatus 71. An image processing apparatus 100 includes a position detection portion 41 for detecting a location of a jam which occurs during feeding of recording paper, a determination portion 42 for determining a jam state based on a detection result of the position detection sensor 69, an examination portion 43 for examining whether the jam has been resolved and a resuming portion 44 for resuming the processing when an examination of the jam location by the examination portion 43 is finished. If the position detection sensor 69 detects the occurrence of the jam (S2), the determination portion determines the jam state and simultaneously provides notification of the occurrence of the jam (S4). If clearing work is finished (S5), the examination portion 43 feeds a test sheet (S6). It is detected whether or not the test sheet passes through the jam location (S8), and the processing is resumed if it is detected within predetermined time (S10).

13 Claims, 11 Drawing Sheets

FIG. 5

JAM DETERMINATION (1)

FOLLOWING TABLE IS PROVIDED TO EACH SENSOR

| NUMBER OF FED SHEETS | FEED PICKUP TIME OR TIME OF ARRIVAL AT SENSOR UPSTREAM BY ONE IN FEEDING DIRECTION | ANTERIOR END ARRIVAL LIMIT TIME | POSTERIOR END PASSAGE LIMIT TIME | STATUS(BEFORE PASSAGE ×, DURING PASSAGE △, AFTER PASSAGE○ | POINTER |
|---|---|---|---|---|---|
| 1 | t01 | t11 | t21 | ○ | |
| 2 | t02 | t12 | t22 | △ | ● |
| 3 | t03 | t13 | t23 | × | |
| | | | | | |
| n | t0n | t1n | t2n | × | |

EXAMPLE OF FEED SENSOR TABLE

| NUMBER OF FED SHEETS | FEED PICKUP TIME | ANTERIOR END ARRIVAL LIMIT TIME | POSTERIOR END PASSAGE LIMIT TIME | STATUS(BEFORE PASSAGE ×, DURING PASSAGE △, AFTER PASSAGE○ | POINTER |
|---|---|---|---|---|---|
| 1 | t01(SETUP) | t11(SETUP) | t21 | × | ● |
| 2 | t02 | t12 | t22 | × | |
| 3 | t03 | t13 | t23 | × | |
| | | | | | |
| n | t0n | t1n | t2n | × | |

TIME T

| NUMBER OF FED SHEETS | FEED PICKUP TIME | ANTERIOR END ARRIVAL LIMIT TIME | POSTERIOR END PASSAGE LIMIT TIME | STATUS(BEFORE PASSAGE ×, DURING PASSAGE △, AFTER PASSAGE○ | POINTER |
|---|---|---|---|---|---|
| 1 | t01 | t11 | t21(SETUP) | △(ANTERIOR END OF FIRST SHEET ARRIVED) | ● |
| 2 | t02(SETUP) | t12(SETUP) | t22 | × | |
| 3 | t03 | t13 | t23 | × | |
| | | | | | |
| n | t0n | t1n | t2n | × | |

| NUMBER OF FED SHEET | FEED PICKUP TIME | ANTERIOR END ARRIVAL LIMIT TIME | POSTERIOR END PASSAGE LIMIT TIME | STATUS(BEFORE PASSAGE ×, DURING PASSAGE △, AFTER PASSAGE○ | POINTER |
|---|---|---|---|---|---|
| 1 | t01 | t11 | t21 | ○(POSTERIOR END OF FIRST SHEET ARRIVED) | |
| 2 | t02 | t12 | t22 | × | ● |
| 3 | t03 | t13 | t23 | × | |
| | | | | | |
| n | t0n | t1n | t2n | × | |

| NUMBER OF FED SHEET | FEED PICKUP TIME | ANTERIOR END ARRIVAL LIMIT TIME | POSTERIOR END PASSAGE LIMIT TIME | STATUS(BEFORE PASSAGE ×, DURING PASSAGE △, AFTER PASSAGE○ | POINTER |
|---|---|---|---|---|---|
| 1 | t01 | t11 | t21 | ○ | |
| 2 | t02 | t12 | t22(SETUP) | △(ANTERIOR END OF SECOND SHEET ARRIVED) | ● |
| 3 | t03(SETUP) | t13(SETUP) | t23 | × | |
| | | | | | |
| n | t0n | t1n | t2n | × | |

| NUMBER OF FED SHEET | FEED PICKUP TIME | ANTERIOR END ARRIVAL LIMIT TIME | POSTERIOR END PASSAGE LIMIT TIME | STATUS(BEFORE PASSAGE ×, DURING PASSAGE △, AFTER PASSAGE○ | POINTER |
|---|---|---|---|---|---|
| 1 | t01 | t11 | t21 | ○ | |
| 2 | t02 | t12 | t22 | ○(POSTERIOR END OF SECOND SHEET PASSED) | |
| 3 | t03 | t13 | t23 | × | ● |
| | | | | | |
| n | t0n | t1n | t2n | × | |

FIG. 6

JAM DETERMINATION (2)

EXAMPLE OF TRANSFER SENSOR TABLE

| NUMBER OF FED SHEETS | FEED SENSOR ARRIVAL TIME | ANTERIOR END ARRIVAL LIMIT TIME | POSTERIOR END PASSAGE TIME LIMIT | STATUS(BEFORE PASSAGE×, DURING PASSAGE△, AFTER PASSAGE○) | POINTER |
|---|---|---|---|---|---|
| 1 | t01 | t11 | t21 | × | ● |
| 2 | t02 | t12 | t22 | × | |
| 3 | t03 | t13 | t23 | × | |
| | | | | | |
| n | t0n | t1n | t2n | × | |

FIG. 7

JAM DETERMINATION (3)

EXAMPLE OF FEED SENSOR TABLE

| NUMBER OF FED SHEETS | FEED PICKUP TIME | ANTERIOR END ARRIVAL LIMIT TIME | POSTERIOR END PASSAGE LIMIT TIME | STATUS(BEFORE PASSAGE×, DURING PASSAGE△, AFTER PASSAGE○ | POINTER |
|---|---|---|---|---|---|
| 1 | t01 | t11 | t21 | × | ● |
| 2 | t02 | t12 | t22 | × | |
| 3 | t03 | t13 | t23 | × | |
| | | | | | |
| n | t0n | t1n | t2n | × | |

TIME T

| NUMBER OF FED SHEETS | FEED PICKUP TIME | ANTERIOR END ARRIVAL LIMIT TIME | POSTERIOR END PASSAGE LIMIT TIME | STATUS(BEFORE PASSAGE×, DURING PASSAGE△, AFTER PASSAGE○ | POINTER |
|---|---|---|---|---|---|
| 1 | t01 | t11 | t21 | △(ANTERIOR END OF FIRST SHEET ARRIVED) | ● |
| 2 | t02 | t12 | t22 | × | |
| 3 | t03 | t13 | t23 | × | |
| | | | | | |
| n | t0n | t1n | t2n | × | |

| NUMBER OF FED SHEETS | FEED PICKUP TIME | END ARRIVAL LIMIT TIME | POSTERIOR END PASSAGE LIMIT TIME | PASSAGE×, DURING PASSAGE△, AFTER PASSAGE○ | POINTER |
|---|---|---|---|---|---|
| 1 | t01 | t11 | t21 | ○(POSTERIOR END OF FIRST SHEET ARRIVED) | |
| 2 | t02 | t12 | t22 | × | ● |
| 3 | t03 | t13 | t23 | × | |
| | | | | | |
| n | t0n | t1n | t2n | × | |

| NUMBER OF FED SHEETS | FEED PICKUP TIME | END ARRIVAL LIMIT TIME | POSTERIOR END PASSAGE LIMIT TIME | PASSAGE×, DURING PASSAGE△, AFTER PASSAGE○ | POINTER |
|---|---|---|---|---|---|
| 1 | t01 | t11 | t21 | ○ | |
| 2 | t02 | t12 | t22 | ×(ANTERIOR END OF SECOND SHEET ARRIVED LATER THAN t12) | ● |
| 3 | t03 | t13 | t23 | × | |
| | | | | | |
| n | t0n | t1n | t2n | × | |

DETERMINED AS FEED SENSOR ARRIVAL JAM

IMAGE PROCESSING APPARATUS

BACKGROUND OF THE INVENTION

1. Field of the Invention

The present invention relates to various image processing apparatuses, such as a printer, a copier and a document reading apparatus.

2. Description of the Related Art

An image processing apparatus performs a variety of image processing, such as a copy mode, a print mode, a scanner mode and a facsimile mode. Such an image processing apparatus includes a document feeding apparatus for feeding a document having information recorded therein to a document mount (contact glass) for reading image information and a paper feeding apparatus for feeding the read image information to a printing portion for printing it on recording paper. These apparatuses feed a bundle of documents or paper sheet by sheet to the document mount or the printing portion.

When feeding a sheet such as the document or the recording paper, there are the cases where multiple sheets are overlappingly fed due to static electricity, humidity or the like. For that reason, the fed sheets lag in a feeding path and a sheet jam (hereinafter referred to as a jam) occurs. In the case where the jam occurs, the location where the jam has occurred is detected so as to remove a jammed sheet and then resume processing. However, there is a possibility, for instance, that minute remainder such as pieces and bits is remaining when removing the sheet. In this case, there is a possibility that the jam may occur again upon resuming the processing.

Thus, as indicated in Japanese Patent Laid-Open No. 08-108968, a disclosure has been made as to a paper jam resolving method of feeding a test sheet before resuming the processing and detecting whether or not the jam has been resolved and a apparatus thereof.

According to Japanese Patent Laid-Open No. 08-108968, the processing is resumed after the test sheet is ejected from a paper path. As for such a method, it takes time before the test sheet passes through the entire paper path in the case where the paper path has a long overall length. In that case, there is a problem that high-speed printing process as an object of the current image processing apparatus cannot be achieved.

Thus, in view of the problem, an object of the present invention is to provide an image processing apparatus which can promptly detect whether or not the jam has been removed in the case of occurrence of the jam such as a paper jam.

SUMMARY OF THE INVENTION

To attain the object, the present invention includes: a feeding portion which feeds a sheet for forming an image; a position detection portion for interrupting processing and detecting an abnormal location upon occurrence of an abnormality while feeding the sheet; an examination portion for examining whether the abnormality of the abnormal location has been resolved by feeding a test sheet to a paper path and checking whether or not the test sheet passes through the paper path; and a resuming portion for resuming the processing when the examination of the abnormal location by the examination portion is finished.

According to the configuration, an image processing apparatus feeds a sheet such as a document or recording paper in order to perform a process of forming an image on a sheet for copying, facsimile, printing or the like. If an abnormality occurs while feeding the sheet, the image processing apparatus interrupts the processing. After resolving the abnormality, the examination portion examines whether the abnormality has been resolved by feeding the test sheet to the abnormal location. To be more specific, it is possible to check whether remainder or pieces are left in the paper path by feeding the test sheet to the abnormal location once. The resuming portion can determine that the abnormality has been resolved when the test sheet arrives at or passes through the abnormal location so as to resume the processing.

Thus, there is no need to wait for the test sheet to be ejected from the paper path so that it is possible to promptly detect whether an abnormal state has been improved and resume the processing earlier. The abnormalities include a sheet jam wherein the sheet gets jammed in the paper path and a misreaction of a detection sensor for detecting passage of the sheet or the like. The abnormal location is a location where the abnormality has occurred, which indicates the location where the sheet being fed is jammed in the paper path as a concrete example.

Here, various test sheets are thinkable. For instance, it is possible to use a sheet of the smallest size feedable through the paper path. The test sheet is destroyed after it is fed. For instance, in the case where a sheet of the largest size feedable through the paper path gets jammed as a cause of the abnormality, it is costly to destroy the sheet each time an equivalent size thereto is fed. Therefore, it is possible to reduce the cost by using the sheet of the smallest size feedable through the paper path as the test sheet.

It is also possible to use the sheet of the largest size feedable through the paper path. In that case, it is possible to check whether remainder or pieces exist over the entire area in a width direction of the paper path no matter what size the jammed sheet has.

It is also possible to use a cleaning sheet of nonwoven fabric, chemical fiber paper or the like for cleaning feeding members. Here, the feeding members are rollers, the paper path and the like which feed the sheets. In that case, the test sheet can check whether the cause of the abnormal location has been resolved and also simultaneously clean the feeding members. It is thereby possible to prevent the sheet from being stained by a toner or the like upon resuming the processing.

It is also possible to use a sheet of the same housing portion as the sheet which was fed upon occurrence of the abnormality. The image processing apparatus includes multiple housing portions for housing the sheets. In that case, the examination can be performed on the same conditions as in the state in which the abnormality has occurred. To be more specific, the examination can be performed along the same feeding path as the feeding path on the abnormality, and so an accurate examination can be performed to the abnormal location. Since the same sheet as the sheet used upon occurrence of the abnormality is used as the test sheet, the resuming portion can resume the processing by using the test sheet. It is thereby possible to resume the processing more promptly.

Furthermore, it is possible to use the sheet of the housing portion at the nearest distance from an abnormality occurrence location. In that case, the test sheet can be fed to the abnormal location earlier. It is thereby possible to reduce the time of being stopped by the abnormality.

The present invention also includes a determination portion for determining the abnormal state based on a detection result of the position detection portion. As for characteristics of these portions, the position detection portion includes multiple position detection sensors for detecting the sheet being fed, the determination portion determines the abnormal state of the sheet based on the detection results of the two adjacent position detection sensors, and the resuming portion resumes the processing from a determination result of the determination portion and the detection results of the two position detection sensors.

To be more precise, in the case where one of the position detection sensors positioned on an upstream side in a sheet feeding direction detects the passage of the sheet while the other position detection sensor positioned on a downstream side in the sheet feeding direction does not detect arrival of the sheet, the determination portion determines the state as a nonarrival jam having the sheet jammed between the one position detection sensor and the other position detection sensor while the resuming portion resumes the processing when the other position detection sensor detects arrival of the fed test sheet.

In the case where one of the position detection sensors continues detecting the sheet for a predetermined time or longer, the determination portion determines the state as a retention jam having the sheet jammed at the location of the position detection sensor having detected the sheet while the resuming portion resumes the processing when the position detection sensor having detected the sheet detects the passage of the fed test sheet.

In the case where one of the position detection sensors is a fixing sensor for detecting whether the sheet being fed has passed through a fixing unit while the other position detection sensor is a transfer sensor for detecting whether the sheet being fed has passed a transfer unit, the resuming portion resumes the processing upon passage of the fed test sheet through the fixing sensor irrespective of the determination results of the determination portion.

If the sheet is jammed in the fixing unit, sticking of the sheet occurs due to heat generated by the fixing unit. For that reason, the resuming portion resumes the processing after the test sheet completely passes through the fixing unit.

BRIEF DESCRIPTION OF THE DRAWINGS

FIG. 5 are drawings showing time tables wherein a position detection sensor is a paper feeding sensor;

FIG. 6 is a drawing showing a time table wherein the position detection sensor is a transfer sensor;

FIG. 7 are drawings showing time tables wherein the position detection sensor is the paper feeding sensor;

DETAILED DESCRIPTION OF THE PREFERRED EMBODIMENTS

Figure 1:
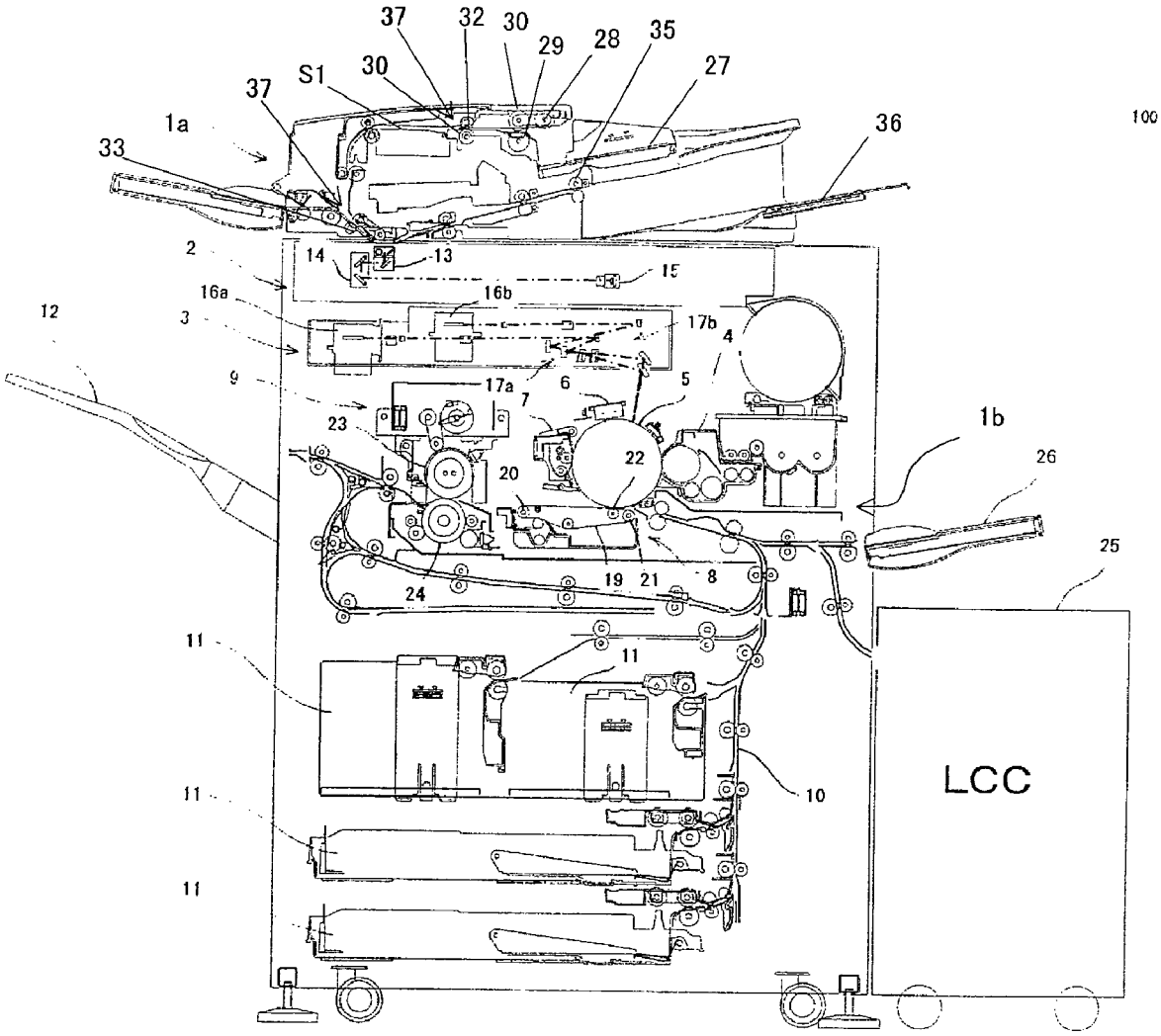
FIG. 1 is an overall configuration diagram of an image processing apparatus according to the present invention.

FIG. 1 shows an image processing apparatus according to this embodiment. An image processing apparatus 100 forms an image in monochrome, in colors or the like on predetermined recording paper fed by a paper feeding apparatus 1*b* according to image data obtained by scanning a document fed by a document feeding apparatus 1*a* which is a sheet feeding apparatus or image data transmitted from outside.

The image processing apparatus 100 includes the document feeding apparatus 1*a*, paper feeding apparatus 1*b*, an image reading portion 2, an optical writing unit 3, a development apparatus 4, a photoreceptor 5, a charger 6, a cleaner unit 7, a transfer unit 8, a fixing unit 9, a paper path 10 and a document path S1.

Figure 2:
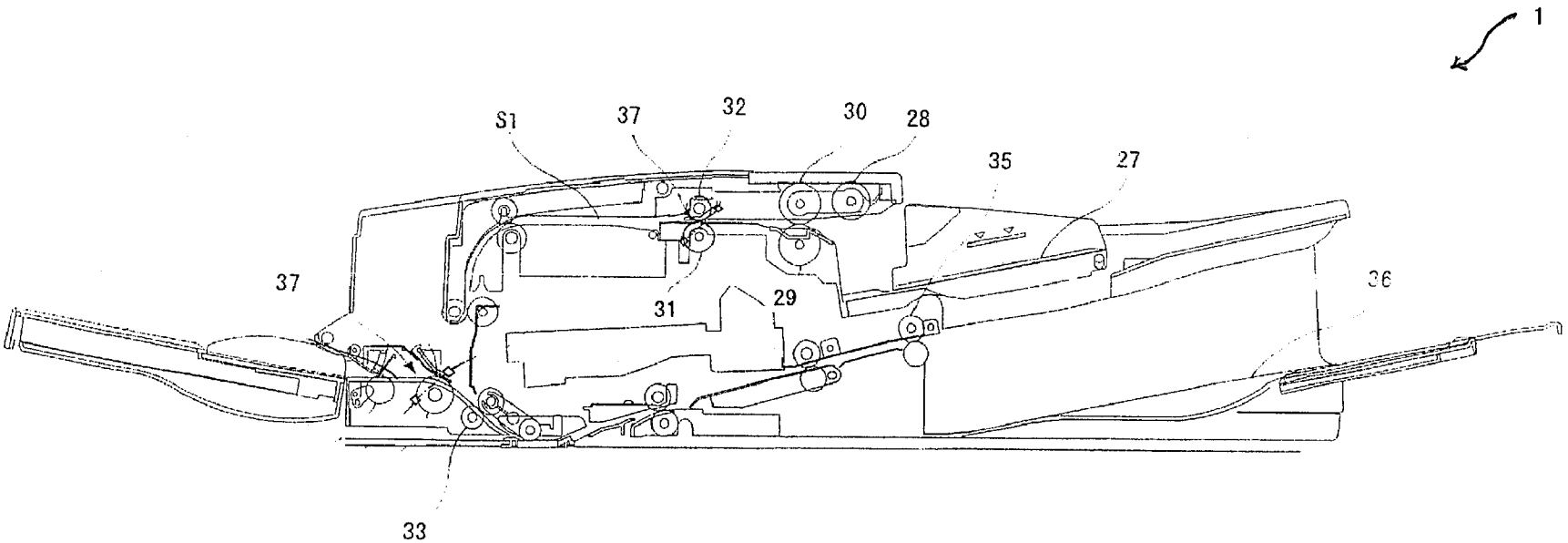
FIG. 2 is a schematic diagram of a document feeding apparatus.

As shown in FIG. 2, the document feeding apparatus 1*a* includes a document tray 27 as a housing portion on which a stack of documents is placed, a pickup roller 28 for feeding a document from the stack of documents to the document path S1, a paper roller 29 and sorting roller 30 for feeding the documents delivered to the document path S1 to a downstream side of the document path S1 while separating them one by one, a pair of feeding rollers 34 composed of a driving roller 31 and a driven roller 32 for feeding the documents along the document path S1, resist rollers 33 for delivering the document to the image reading portion 2 in predetermined timing, and a paper ejection roller 37 for discharging the document having been subjected to image reading to a catch tray 36.

Of the stack of documents placed on the document tray 27, the document feeding apparatus 1*a* delivers a top document by the pickup roller 28 and feeds them one by one to the document path S1 by the paper roller 29 and the sorting roller 30 rotating in the same direction. And the document feeding apparatus 1*a* feeds the fed document to the image reading portion 2 through the feeding rollers 34 and the resist rollers 33. Thereafter, the document having been subjected to image reading is discharged to the catch tray 36 by the paper ejection roller 37.

The image reading portion 2 includes a light source holder 13, a mirror group 14 and a CCD 15. In the case of scanning the document sent from the document feeding apparatus 1*a*, the light source holder 13 and the mirror group 14 scan the image of the document in a standstill state. To be more precise, if the document is fed from the document feeding apparatus 1*a*, light is emitted on the document from a light source of the light source holder 13. And the light reflected off the document has its light path converted via the mirror group 14 and is focused on the CCD 15 so as to be converted to electronic image data.

The charger 6 is charging means for evenly charging the surface of the photoreceptor 5 at a predetermined potential. This embodiment uses the charger 6 of a charger type. However, a charger of a contacting roller type or a brush type may also be used.

To handle high-speed printing process, the optical writing unit 3 adopts a two-beam method including two laser irradiation portions 16*a* and 16*b*, where a burden in conjunction with speeding up of irradiation timing is alleviated. A laser beam is emitted from the laser irradiation portions 16*a* and 16*b* according to inputted image data so as to expose the photoreceptor 5 evenly charged by the charger 6 via mirror groups 17*a* and 17*b*. Thus, an electrostatic latent image according to the image data is formed on the surface of the photoreceptor 5.

This embodiment uses a laser scanning unit including the laser irradiation portions 16*a*, 16*b* and the mirror groups 17*a*, 17*b* as the optical writing unit 3. However, it is also possible to use an EL writing head or an LED writing head having light-emitting elements arranged like an array.

The development apparatus 4 placed in proximity to the photoreceptor 5 forms an actual image of the electrostatic latent image formed on the surface of the photoreceptor 5 with a black toner. The cleaner unit 7 placed around the photoreceptor 5 eliminates and collects the toner remaining on the surface of the photoreceptor 5 after the development and image transfer.

The electrostatic image actually formed on the surface of the photoreceptor 5 is transferred on the recording paper by applying to the fed sheet of paper an electric field of a reverse polarity to a charge of the electrostatic image from the transfer unit 8. In the case where the electrostatic image has a charge of negative polarity for instance, the applied polarity of the transfer unit 8 is positive polarity.

A transfer belt 19 of the transfer unit 8 is stretched by a driving roller 20, a driven roller 21 and other rollers, and has a predetermined resistance value ($1\times10^{9}$ to $1\times10^{13}$ Ω·cm). An elastic conductive roller 22 having conductive property and capable of applying a transfer field is placed in a contact portion between the photoreceptor 5 and the transfer belt 19.

The electrostatic image transferred on the recording paper by the transfer unit 8, that is, an unfixed toner is fed to the fixing unit 9 so that the unfixed toner is melted and fixed on the recording paper.

The fixing unit 9 includes a heating roller 23 and a pressure roller 24. In an inner circumferential portion of the heating roller 23, there contains a heat source for keeping the surface of the heating roller 23 at a predetermined temperature (about 160 to 200° C.). The pressure roller 24 has pressure members not shown placed at its both ends so as to contact the heating roller 23 at a predetermined pressure.

Thus, the unfixed toner on the sheet being fed is heated and melted by the heating roller 23, and then fixed on the sheet by the pressure members via the pressure roller 24.

Figure 3:
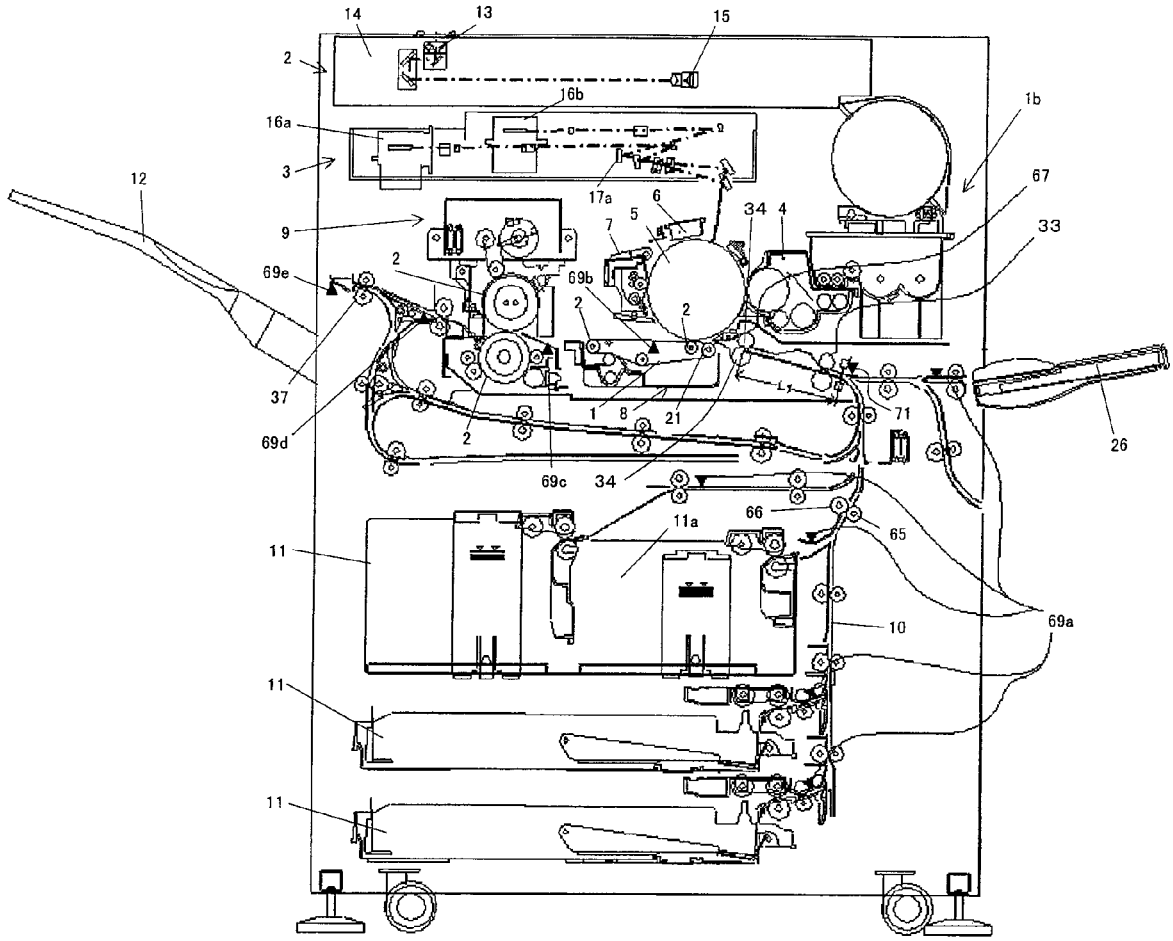
FIG. 3 is a schematic diagram of a paper feeding apparatus.

As shown in FIG. 3, the paper feeding apparatus 1*b* includes a paper feed tray 11 for accumulating the recording paper to be used for image formation, a pickup roller 61 for delivering the recording paper from a stack of the recording paper to the paper path 10, a paper roller 63 and sorting roller 64 for feeding the recording paper delivered to the paper path 10 to the downstream side of the paper path 10 while separating them one by one, a pair of feeding rollers 66*a* composed of a driving roller 65 and a driven roller 66 for feeding the recording paper along the paper path 10, resist rollers 67 for delivering the recording paper to the optical writing unit 3 in predetermined timing, a paper ejection roller 73 for discharging the recording paper having been subjected to image printing process to a catch tray 12, and a position detection sensor 69 for detecting whether the recording paper fed from the paper feed tray 11 or a manual tray 26 has passed through the paper path 10 in predetermined timing.

The paper feed tray 11 is a housing portion for accumulating the recording paper to be used for the image formation. Upon a printing request from a user, the paper feed tray 11 is moved upward to put the upside of the stack of the recording paper in contact with the pickup roller 61. In this embodiment, a plurality of the paper feed trays 11 are provided in the lower part of the image processing apparatus 100.

As an object of this embodiment is the high-speed printing process, each of the paper feed trays 11 has a secured capacity capable of accommodating 500 to 1500 sheets of standard-size recording paper. The image processing apparatus 100 is provided beside it with a large-capacity paper cassette 25 capable of accommodating large amounts of multiple kinds of the recording paper and the manual tray 26 to be used for printing of a nonstandard size and the like.

The pickup roller 61 is a roller for delivering the recording paper to the paper path 10 from the stack of the recording paper, and is placed above the end on the downstream side in the feeding direction of the paper feed tray 11. The pickup roller 28 delivers to the paper path 10 a sheet of the recording paper positioned at the top of the stack of the recording paper placed on the paper feed tray 11.

The paper roller 63 is a roller, as a pair with the sorting roller 64, for delivering the recording paper to the paper path 10, which delivers the recording paper fed from the pickup roller 61 to the paper path 10 one by one. To be more precise, the paper roller 63 and the sorting roller 64 are rotated in the same direction by a drive unit such as a motor respectively. The paper roller 63 is positioned on the downside against the sorting roller 64 by sandwiching the paper path 10. It is thereby possible to deliver the overlappingly fed recording paper to the paper path 10 one by one.

The feeding rollers 66*a* are a pair of rollers composed of the driving roller 65 and the driven roller 66, which sequentially feed the recording paper flowing along the paper path 10. A plurality of the feeding rollers 66*a* are provided to the paper path 10.

The driving roller 65 is rotated by the drive unit such as a motor. The driving roller 65 is positioned on the downside against the driven roller 66 by sandwiching the paper path 10. The driven roller 66 is a roller for pressing the fed document against the driving roller 65, and rotates by following rotation of the driving roller 65. There is space for one sheet of the recording paper to pass between the driving roller 65 and the driven roller 66. To be more specific, the fed recording paper is sandwiched by the driving roller 65 and the driven roller 66. Thus, the driving roller 65 can accurately transmit the rotation to the recording paper and feed it without stopping.

The resist rollers 67 are a pair of rollers composed of the driving roller 67*a* rotated by the drive unit such as the motor and the driven roller 67*b* rotated by following the rotation of the driving roller 67*a*. The resist rollers 67 are positioned on the upstream side in the feeding direction against the photoreceptor 5. The resist rollers 67 align the ends of the recording paper fed by the feeding rollers 66*a*, and feed it to the photoreceptor 5 in predetermined timing.

The catch tray 12 is placed on the opposite side to the manual tray 26. A post-processing (stapling, punching or the like) apparatus of ejected paper or a multistage catch tray may also be placed as an option instead of the catch tray 12.

The position detection sensor 69 is a detection apparatus such as a limit switch or an optical sensor, which detects whether the recording paper flowing through the paper path 10 has passed in predetermined timing. As shown in FIG. 3, a plurality of the position detection sensors 69 are provided to the paper path 10.

Figure 4:
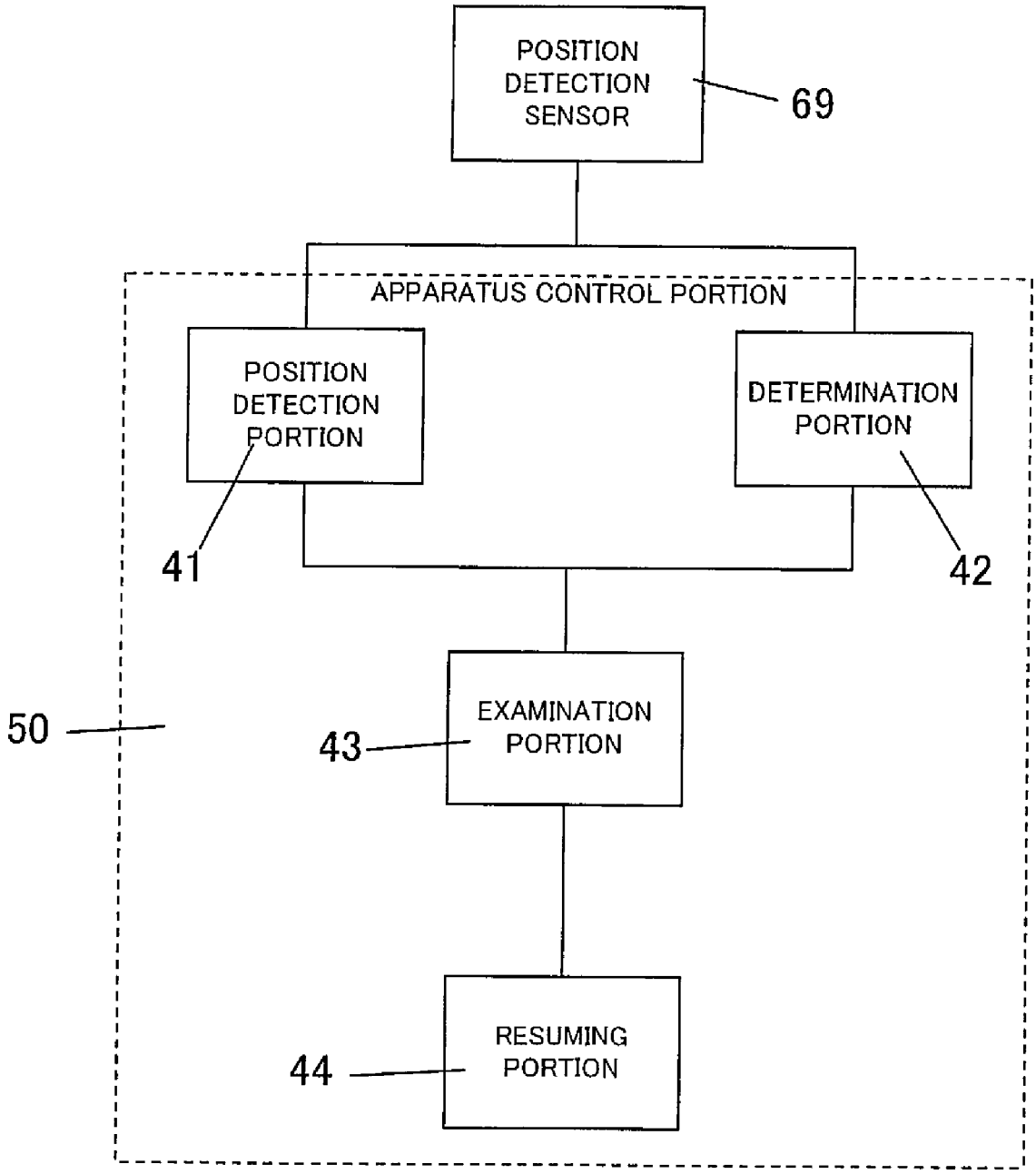
FIG. 4 is a block diagram of a apparatus control portion.

As shown in FIG. 4, the image processing apparatus 100 includes an operating portion 51 for receiving an input of the user, a hard disk drive 52 for storing image data, a communication portion 53 for performing data communication with external apparatuses, a FAX modem 54 for performing communication with a facsimile apparatus, a management portion 55 storing control information and configuration information on the entire apparatus, and a apparatus control portion 50 composed of a CPU for controlling the entire apparatus.

The operating portion 51 includes an input portion composed of various input keys and a display such as a liquid crystal display. The display is a touch panel, which also functions as the input portion. In the operating portion 51, operating instructions and various settings of the entire apparatus are inputted and input contents and operating conditions of the entire apparatus are displayed. The operating portion 51 receives the input of the operating instructions.

The hard disk drive 52 stores the image data temporarily. An encryption/decryption portion performs an encryption process or a decryption process on the image data. When the image data is stored in the hard disk drive 52, the image data is encrypted by the encryption/decryption portion. When reading out the encrypted image data from the hard disk drive 52, the image data is decrypted.

The communication portion 53 is connected to a router, a switching hub and the like via a LAN cable, and is connected to a network formed by information processing apparatuses such as personal computers and servers. The network is connected to the Internet via a communication line such as a telephone line network or an optical fiber. The communication portion 53 sends and receives the data to and from the information processing apparatuses in the network, and also sends and receives the data and e-mail to and from external information processing apparatuses through the Internet. Furthermore, the communication portion 53 performs Internet facsimile communication with the facsimile apparatus through the Internet. The FAX modem is connected to the telephone line network via a telephone line, and performs facsimile communication with external facsimile apparatuses.

The communication portion 53 and the FAX modem 54 receive and input the image data from the external apparatuses, such as the information processing apparatuses and facsimile apparatuses. To be more specific, they function as image data inputting means. When inputting the image data from the external apparatuses, the communication portion 53 simultaneously receives the input of the operating instructions so as to also function as input means. Furthermore, the communication portion 53 and the FAX modem 54 perform a process of transmitting the image data to the external apparatuses and thereby function as an image data input portion.

The apparatus control portion 50 includes a CPU, a ROM for storing a control program executed by the CPU, a RAM for providing a work area to the CPU, a nonvolatile memory for holding control data, an input circuit to which signals from detection means of each portion of the image processing apparatus 100 are inputted, a driver circuit for driving an actuator and the motor which activate a drive mechanism of each portion of the image processing apparatus 100, and an output circuit for driving the laser irradiation portions 16*a* and 16*b*.

Next, the paper feeding apparatus 1*b* will be described in detail based on FIGS. 5 to 10. As mentioned earlier, as to the paper feeding apparatus 1*b*, the paper feed tray 11 is moved upward based on a printing instruction from the user, and then the pickup roller 61 feeds the recording paper to the paper path 10 starting from the one positioned at the top of the recording paper stack so as to be fed one by one by the paper roller 63 and the sorting roller 64 to the downstream side in the feeding direction of the paper path 10.

Under ordinary circumstances, in the case where two or more sheets of the recording paper are overlappingly fed to the paper path 10, the overlapped feeding state is resolved by the sorting roller 30, and the sheets are fed one by one by the paper roller 29 to the downstream side in the feeding direction of the paper path 10 as mentioned above.

However, the paper feeding apparatus 1*b* of this embodiment needs to feed the recording paper at high speed in order to handle high-speed printing process. For that reason, there is a possibility that two or more sheets of the recording paper may be overlappingly fed even if the sorting roller 64 is provided. In that case, there is a possibility that a jam may occur with the recording paper staying inside the paper path 10.

Under ordinary circumstances, in the case where the jam occurs, the recording paper as the cause of the jam is cleared by man-caused work of the user, an administrator or the like, and image processing is resumed after the clearing work is finished. When clearing the recording paper as the cause of the jam, however, there is a possibility that minute remainder of the recording paper may remain as a result of the recording paper getting sandwiched and cut by the feeding rollers 66*a*, getting stuck to the feeding rollers 66*a* due to heat or the like.

Thus, the image processing apparatus 100 of this embodiment clears the jammed recording paper, and feeds a test sheet through the paper path 10 once after the clearing work in order to check whether the jam has been resolved. On detecting that the fed test sheet passes the jammed location, the image processing apparatus 100 resumes the processing.

To be more precise, the image processing apparatus 100 includes a position detection portion 41 for detecting a location of a jam which occurs during feeding of the recording paper, a determination portion 42 for determining a jam state based on a detection result of the position detection sensor 69, an examination portion 43 for examining whether the jam has been resolved and a resuming portion 44 for resuming the processing when the examination of the jam location by the examination portion 43 is finished.

The position detection portion 41 identifies the jam location inside the paper path 10 from outputs of multiple position detection sensors 69 for detecting the recording paper being fed.

The determination portion 42 determines the jam state of the recording paper from the detection result of the position detection sensor 69, such as whether the jam is a retention jam staying at the location of the position detection sensor 69 or a nonarrival jam not arriving at the next position detection sensor 69. To be more precise, the determination portion 42 stores detection time of each of the position detection sensors 69 so as to create a timetable. The determination portion 42 determines whether the jam is the nonarrival jam or the retention jam from the detection times of the position detection sensors 69.

To be more precise, in the case where the position detection sensor 69 is a paper feed sensor 69*a* as shown in FIG. 5, if the time when the recording paper was picked up from the paper feed tray 11 is set as t01, a time limit until the paper feed sensor 69*a* detects the ends of the fed recording paper is set as t11. In that case, a passage state of the recording paper becomes before passage. And if the recording paper arrives at the paper feed sensor 69*a*, the passage state of the recording paper becomes during passage. In the case where the paper feed sensor 69*a* does not detect the recording paper by the predetermined time t11, the determination portion 42 determines it as the nonarrival jam jammed between the paper feed tray 11 and the paper feed sensor 69*a*.

If the recording paper arrives at the paper feed sensor 69*a*, a time t21 is set up as the time until the recording paper passes. If the recording paper passes the paper feed sensor 69*a*, the passage state of the recording paper becomes after passage. In the case where the recording paper does not pass the paper feed sensor 69*a* by the predetermined time t21, the determination portion 42 determines it as the retention jam having the recording paper staying at the location.

Simultaneously with the passage of the recording paper through the paper feed sensor 69*a*, a time t02 is set up as the time when a next sheet of the recording paper is picked up, and an arrival time t12 of the sheet of the recording paper is also set up. The determination portion 42 checks what-numbered sheet is being detected with a pointer.

In the case where the position detection sensor 69 is the paper feed sensor 69*a*, if the time when a sheet of the recording paper is picked up from the paper feed tray 11 is t01 as shown in FIG. 7, the time limit for the paper feed sensor 69*a* to detect the ends of the fed recording paper is t11. To be more specific, if the paper feed sensor 69*a* cannot detect the fed recording paper by the predetermined time t11 after the recording paper is fed, the determination portion 42 determines it as the nonarrival jam jammed between the paper feed tray 11 and the paper feed sensor 69*a*. The time required from the detection of an anterior end of the recording paper until the passage of a posterior end thereof is t21. Therefore, in the case where the recording paper does not pass the paper feed sensor 69*a* by that time, the determination portion 42 determines it as the retention jam having the recording paper staying at the location.

In the case where the position detection sensor 69 is a transfer sensor 69*b*, if the time when the paper feed sensor 69*a* detected the recording paper is t01 as shown in FIG. 6, the time limit until the transfer sensor 69*b* detects the end of the fed recording paper is t11. To be more specific, if the transfer sensor 69*b* cannot detect the fed recording paper by the predetermined time t11 after the recording paper is detected by the paper feed sensor 69*a*, the determination portion 42 determines it as the nonarrival jam jammed between the paper feed sensor 69*a* and the transfer sensor 69*b*. The time required from the detection of the anterior end of the recording paper until the passage of posterior end thereof is t21. Therefore, in the case where the recording paper does not pass the transfer sensor 69*b* by that time, the determination portion 42 determines it as the retention jam having the recording paper staying at the location.

Figure 9:
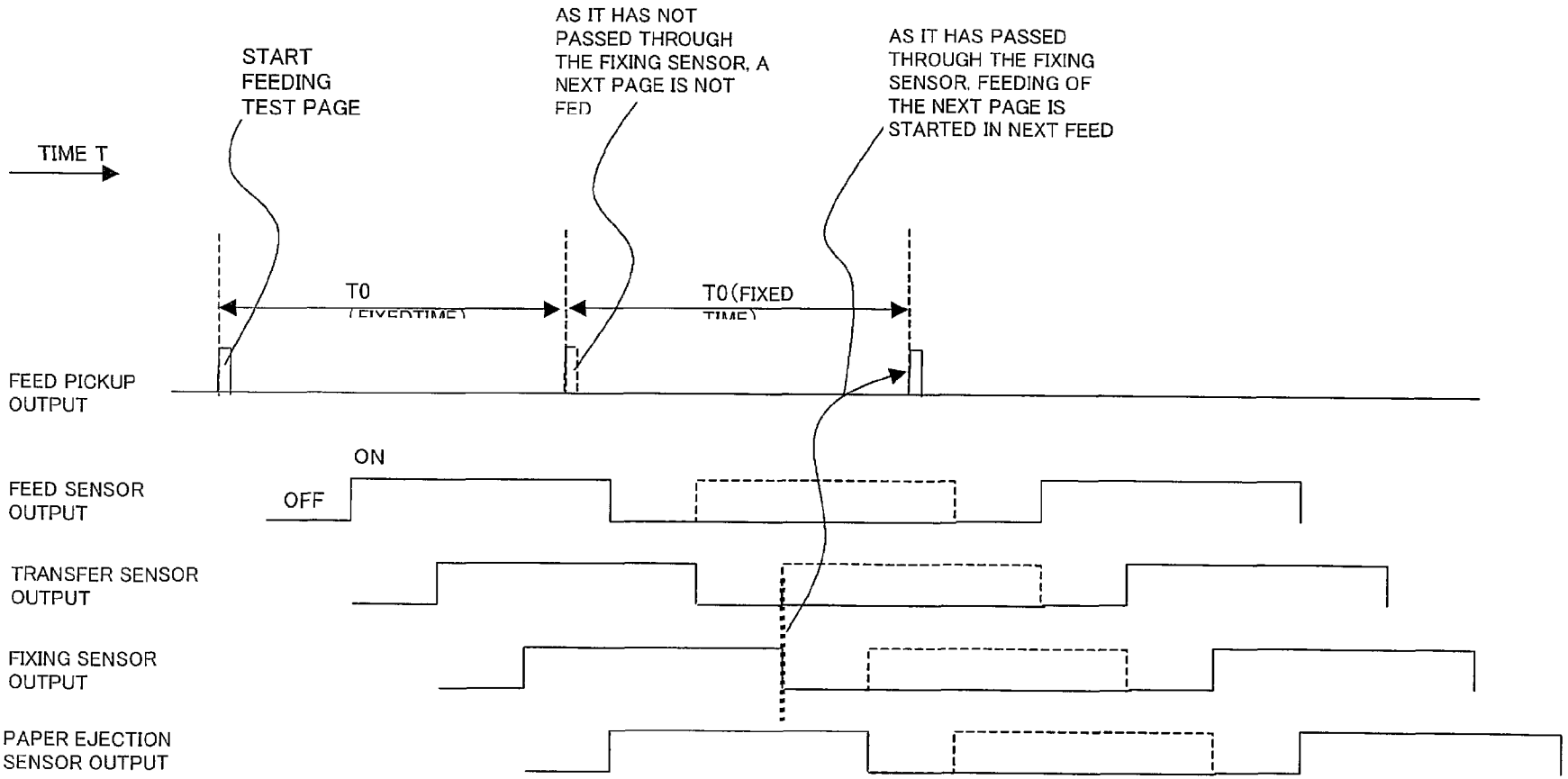
FIG. 9 is a drawing showing the time-line outputs of each position detection sensor in the case of resuming paper feeding in a predetermined time.

In the case where the position detection sensor 69 is a fixing sensor 69*c*, a paper ejection sensor 69*d* or a paper ejection sensor 69*e* as shown in FIG. 9, the arrival time and transit time are set up from the time detected by the position detection sensor 69 on the upstream side of each of the position detection sensors 69. In the case where the recording paper is not detected or does not pass within the time, the determination portion 42 determines it likewise as the nonarrival jam or the retention jam.

To check whether the recording paper has been cleared at the location where the jam has occurred, the examination portion 43 drives the feeding rollers 66*a* to feed the test sheet and receives the output from the position detection sensor 69 as to whether the recording paper has arrived at or passed through the jammed location. The examination portion identifies whether or not the jam has been resolved based on the output from the position detection sensor 69.

Here, the test sheet is the recording paper which is fed following the jammed recording paper. Under ordinary circumstances, the recording paper is continuously fed through the paper path 10. For that reason, the recording paper which has already been fed is staying up to the jammed location. Therefore, it is not possible to newly feed the test sheet. Thus, to promptly feed the test sheet to the jammed location, the recording paper standing by in the paper path 10 at the nearest location from the jammed location is used. It is thereby possible to feed the test sheet to the jammed location without clearing the recording paper staying on the upstream side in the feeding direction from the jammed location.

In the case where the recording paper already fed and staying in the paper path is also cleared on clearing the jammed recording paper, the examination portion 43 feeds the recording paper housed in the same paper feed tray 11 as the recording paper which was being fed on the occurrence of the jam. It is thereby possible to perform the examination under the same conditions as those in the state where the jam occurred. To be more specific, the examination can be performed along the same feeding route as when the jam occurred, so that the jammed location can be accurately examined.

The test sheet is not especially limited thereto but may be anything that can be fed through the paper path 10. For instance, it may be the smallest-size sheet feedable through the paper path 10, the largest-width sheet feedable through the paper path 10, a cleaning sheet of nonwoven fabric, chemical fiber paper or the like for cleaning feeding members or the sheet of a paper feed tray 11*a* at the nearest distance from the location where the jam occurred.

Figure 8:
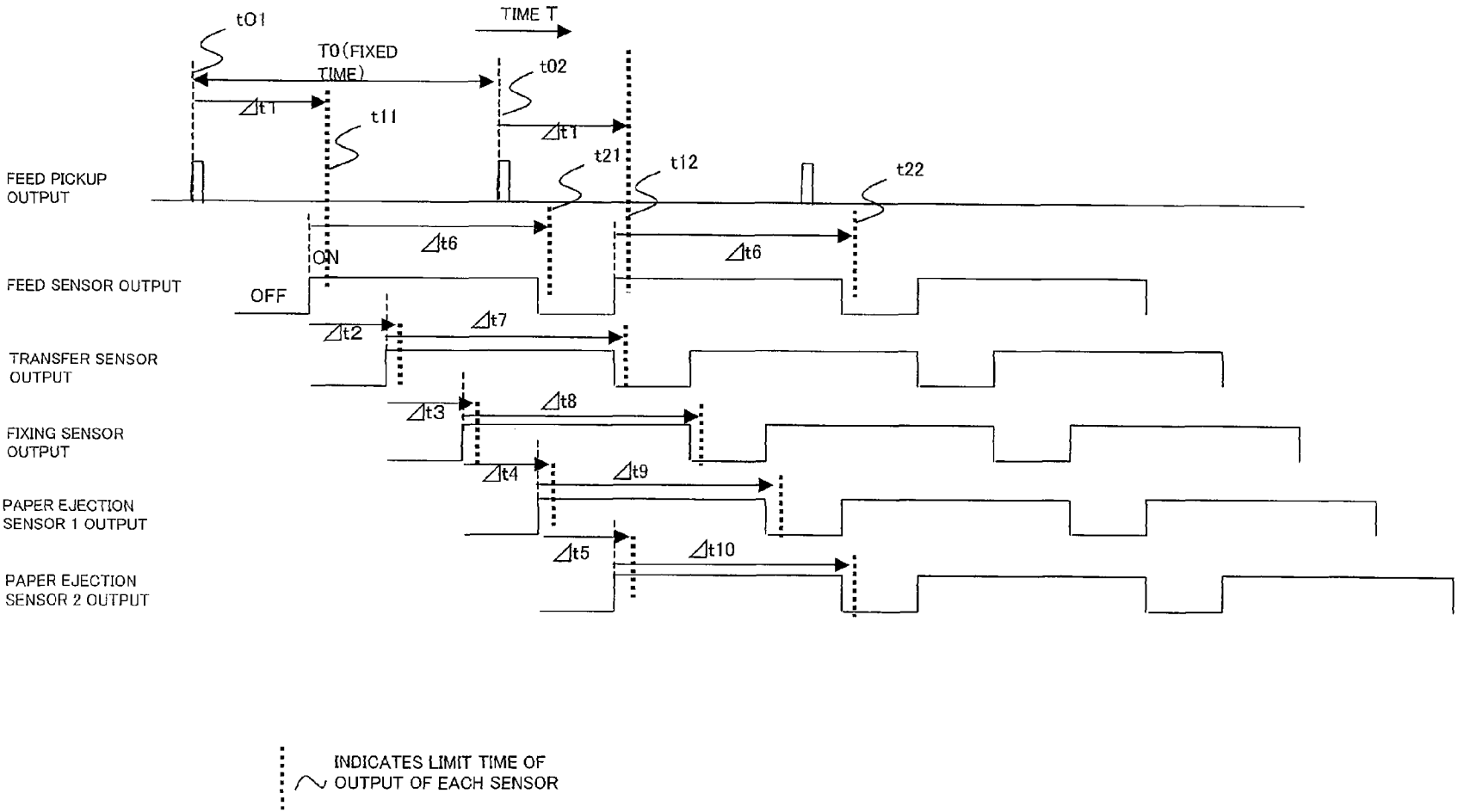
FIG. 8 is a drawing showing time-line outputs of each position detection sensor under normal conditions.

The resuming portion 44 resumes the stopped processing by taking the passage of the test sheet through the jammed location as a cue. To be more precise, the recording paper is normally fed from the paper feed tray 11 in a given time T0 as shown in FIG. 8. In the case where the jam occurs and the processing stops, the feeding of the recording paper from the paper feed tray 11 is stopped once. Thereafter, the processing is resumed after the examination of the examination portion 43 is finished.

Figure 10:
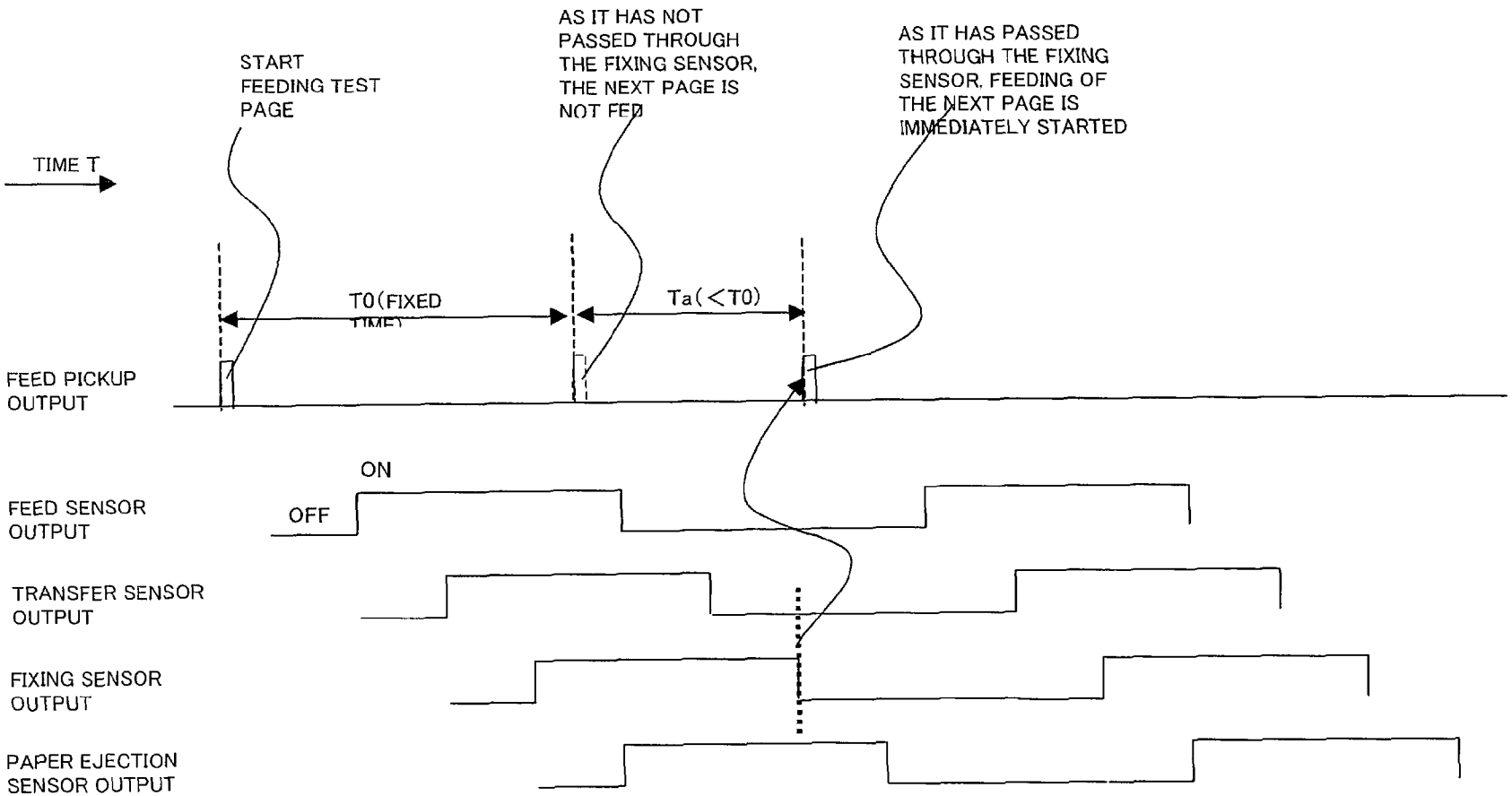
FIG. 10 is a drawing showing the time-line outputs of each position detection sensor in the case of resuming the paper feeding upon resolving a jam.

Here, various starts of the processing are thinkable. As shown in FIG. 10 for instance, as for the timing for feeding the recording paper, the feeding is always performed at an interval of the given time T0 from the previous time when the feeding was performed. To be more specific, the processing is started in feeding timing that comes first after the examination of the jammed location by the examination portion 43 is finished. Thus, the intervals among the recording paper in the paper path 10 become always constant so that the recording paper will not mutually overlap.

As shown in FIG. 9, the processing is resumed as soon as the examination of the jammed location by the examination portion 43 is finished. It is thereby possible to return more promptly from the stop due to the jam.

Figure 11:
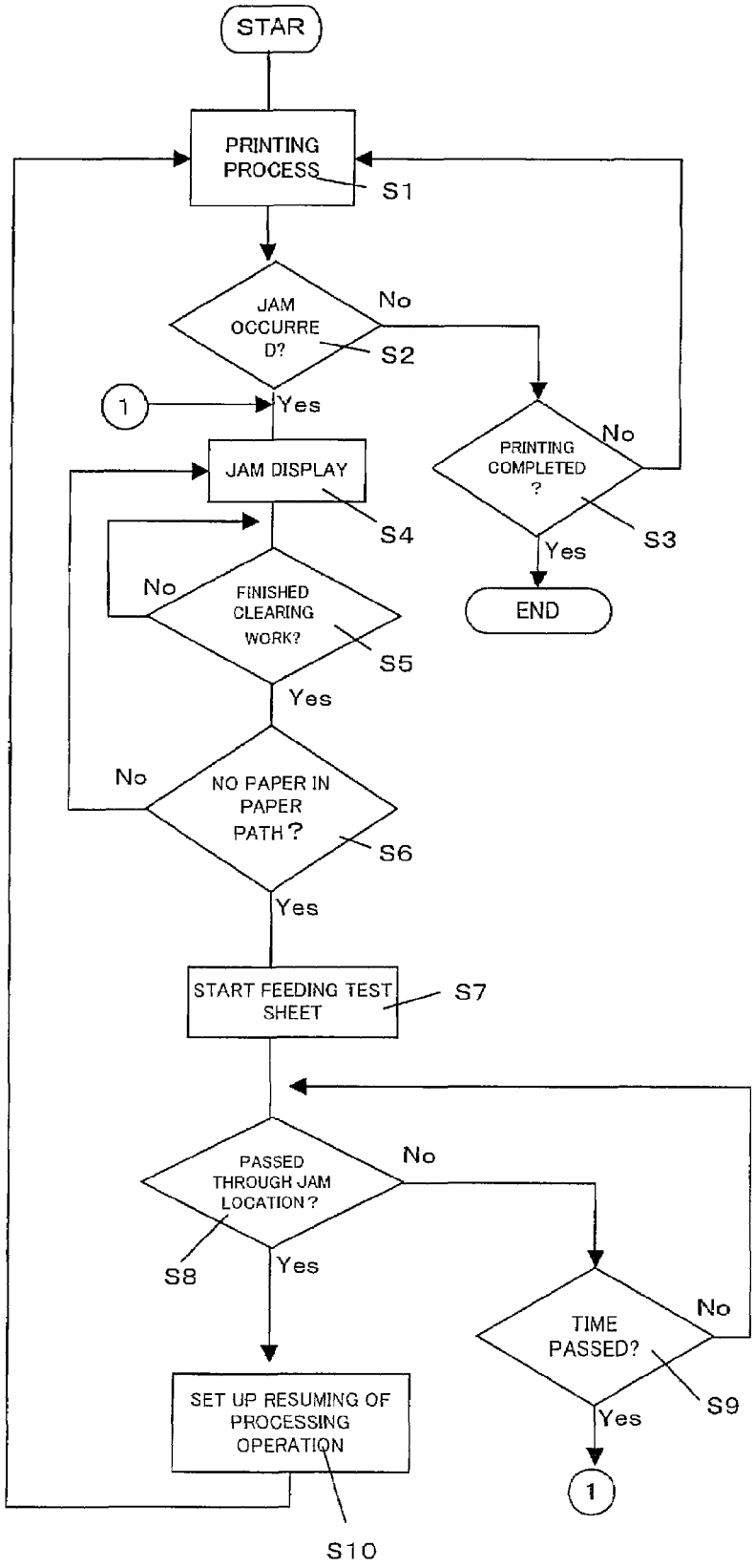
FIG. 11 is a flowchart showing occurrence to resuming of the jam.

Next, a description will be given by referring to FIG. 11 as to operations from the occurrence of the jam to the resuming of the image processing of the image processing apparatus 100 configured as above.

First, upon a printing instruction from the apparatus control portion 50, the recording paper is delivered to the paper path 10 by the pickup roller 61 starting from the one positioned at the top in the paper feed tray 11 in which the specified recording paper is housed. The delivered recording paper is fed one by one by the paper roller 63 and the sorting roller 64 to the downstream side in the feeding direction of the paper path 10. And the fed recording paper is fed along the paper path 10 by the feeding rollers 66*a* (S1).

In that case, the apparatus control portion 50 determines whether or not the jam has occurred from the detection results of the multiple position detection sensors 69 provided to the paper path 10 (S2). In the case where the occurrence of the jam is not detected, the apparatus control portion 50 checks whether the processing is finished (S3). In the case where the processing is finished, it is finished as-is. In the case where the processing is not finished, the printing process is continued (S1).

In the case where the apparatus control portion 50 determines that the jam has occurred, it notifies the user thereof (S4). In that case, the position detection portion 41 of the apparatus control portion 50 identifies the location of the jam occurrence based on the detection results from the position detection sensors 69 and notifies the user thereof.

The determination portion 42 of the apparatus control portion 50 determines the jam state based on the detection results from the position detection sensors 69. To be more specific, it determines whether the jam is the retention jam staying at the location of the position detection sensor 69 or the nonarrival jam not arriving at the next position detection sensor 69.

Upon notification of the jam occurrence, the user or the administrator performs the clearing work of the recording paper as the cause of the jam. As an open/close sensor is provided to a cover of the image processing apparatus 100, the apparatus control portion 50 checks whether the clearing work is finished by the detection result from the open/close sensor (S5). After checking that the cover is closed and checking that the clearing work is finished, the apparatus control portion 50 checks whether the recording paper is in the paper path 10 (S6). If it determines that the recording paper still remains, the notification of the jam occurrence is performed again so that the user or the administrator performs the clearing work of the recording paper as the cause of the jam.

If the apparatus control portion 50 determines that no recording paper remains in the paper path 10, the examination portion 43 feeds the test sheet (S7). The test sheet is the recording paper housed in the same paper feed tray 11 in which the recording paper which was being fed on the occurrence of the jam was housed, that is, the same recording paper as the recording paper which was being fed on the occurrence of the jam.

Next, it is detected whether or not the fed test sheet passes through the jammed location (S8). In the case where the fed test sheet is not detected, the apparatus control portion 50 checks whether predetermined time has passed since the test sheet was detected by the position detection sensor 69 on the upstream side of the position detection sensors 69 of the jammed location (S9). In the case where the predetermined time has not passed, it is checked again whether there is detection from the position detection sensors 69 of the jammed location (S8). In the case where the test sheet has not passed within the predetermined time, it is determined that the jam has occurred, and the user is notified thereof (S4). In the case where the test sheet has passed within the predetermined time, it is determined that the jam has been resolved so that the resuming portion 44 resumes the processing (S10).

Here, the timing in which the resuming portion 44 resumes is different according to the jam state determined by the determination portion 42. In the case where the jam is determined to be the nonarrival jam for instance, the processing is resumed when the position detection sensor 69 detects the anterior end of the fed test sheet. In the case where the jam is determined to be the retention jam, the processing is resumed when the position detection sensor 69 detects the passage of the fed test sheet, that is, the posterior end of the test sheet. In the case where the position detection sensors are the fixing sensor for detecting whether the sheet has passed through the fixing unit 9 and the transfer sensor for detecting whether the sheet has passed the transfer unit 8, however, the resuming portion 44 resumes the processing upon the passage of the posterior end of the fed test sheet through the fixing sensor irrespective of a determination result of the determination portion 42.

The present invention is not limited to the embodiment, but many modifications and changes may be made to the embodiment without departing from the scope of the invention as a matter of course. As the image processing apparatus, it may be a complex machine including a copy mode and a print mode or a dedicated machine of only a single mode such as a copier, a scanner or a printer.

This embodiment describes the case where the present invention is provided to the paper feeding apparatus. However, it is not limited thereto but may also be adopted to the document feeding apparatus.

The examination portion examines whether the abnormality of the paper path has been resolved by feeding the test sheet. However, it is not limited thereto. For instance, a test plate is provided to each of the position detection sensors. The examination portion examines whether the position detection sensor performs the outputs of on/off and the like by moving the test plate. According to the configuration, in the case where the abnormality occurred due to a malfunction of the position detection sensor, the examination portion can check that the abnormality has been overcome.

What is claimed is:

1. An image processing apparatus comprising:

a feeding portion for feeding a sheet through a paper path to form an image;

a position detection portion, having multiple position detection sensors for detecting the sheet being fed, for interrupting processing and detecting an abnormal location along the paper path, upon occurrence of an abnormality while feeding the sheet, based on the detection results of the position detection sensors;

an examination portion for examining whether the abnormality has been resolved by feeding a test sheet to the paper path based on whether or not the position detection sensor which detected the abnormal location detects the sheet has passed; and a resuming portion for resuming the processing when the examination portion examines that the test sheet passed within a predetermined time through the abnormal location detected by the position detection sensor, wherein the time for resuming the processing is a function of the location of the abnormal location along the paper path.

2. The image processing apparatus according to claim 1, wherein the test sheet is a sheet of the smallest size feedable through the paper path.

3. The image processing apparatus according to claim 1, wherein the test sheet is a sheet of the largest width feedable through the paper path.

4. The image processing apparatus according to claim 1, wherein the test sheet is a cleaning sheet for cleaning feeding members.

5. The image processing apparatus according to claim 1, further comprising:

multiple housing portions for housing the sheets, wherein the test sheet is a sheet of the same housing portion as the sheet which has been fed upon occurrence of the abnormality.

6. The image processing apparatus according to claim 5, wherein the resuming portion resumes the processing by using the test sheet.

7. The image processing apparatus according to claim 1, further comprising:

multiple housing portions for housing the sheets, wherein the test sheet is a sheet of the housing portion at the nearest distance from an abnormality occurrence location.

8. The image processing apparatus according to claim 1, further comprising:

a determination portion for determining an abnormal state based on a detection result of the position detection portion, and wherein the position detection portion includes multiple position detection sensors for detecting the sheet being fed;

the determination portion determines the abnormal state of the sheet based on the detection results of the two adjacent position detection sensors; and the resuming portion resumes the processing from a determination result of the determination portion and the detection results of the two position detection sensors.

9. The image processing apparatus according to claim 8, wherein, when one of the position detection sensors positioned on an upstream side in a sheet feeding direction detects passage of the sheet while the other position detection sensor positioned on a downstream side in the sheet feeding direction does not detect arrival of the sheet, the determination portion determines it as a nonarrival jam having the sheet jammed between the one position detection sensor and the other position detection sensor.

10. The image processing apparatus according to claim 9, wherein, if the determination portion determines it as the nonarrival jam, the resuming portion resumes the processing when the other position detection sensor detects the arrival of the test sheet.

11. The image processing apparatus according to claim 8, wherein, when one of the position detection sensors continues detecting the sheet for a predetermined time or longer, the determination portion determines it as a retention jam having the sheet jammed at the location of the position detection sensor having detected the sheet.

12. The image processing apparatus according to claim 11, wherein, when the determination portion determines it as a retention jam, the resuming portion resumes the processing when the position detection sensor having detected the sheet detects the passage of the test sheet.

13. The image processing apparatus according to claim 8, wherein one of the position detection sensors is a fixing sensor for detecting whether the sheet has passed through a fixing unit while the other position detection sensor is a transfer sensor for detecting whether the sheet has passed through a transfer unit, and the resuming portion resumes the processing upon passage of the test sheet through the fixing sensor irrespective of the determination results of the determination portion.

* * * * *